US005520340A

United States Patent [19]

Kröckert et al.

[11] Patent Number: 5,520,340

[45] Date of Patent: May 28, 1996

[54] PROCESS FOR THE JET MILLING OF INORGANIC PIGMENTS

[75] Inventors: Bernd Kröckert, Wesel; Günter Linde; Peter Kuske, both of Krefeld, all of Germany

[73] Assignee: Bayer Aktiengesellschaft, Germany

[21] Appl. No.: 972,220

[22] Filed: Nov. 5, 1992

[30] Foreign Application Priority Data

Nov. 18, 1991 [DE] Germany ..... 41 37 901.2

[51] Int. Cl.[6] ..... B02C 19/06

[52] U.S. Cl. ..... 241/5; 241/18; 241/29

[58] Field of Search ..... 241/5, 29, 232, 241/18

[56] References Cited

U.S. PATENT DOCUMENTS

| | | | |
|---|---|---|---|
| 1,718,184 | 6/1929 | Ostermann | 241/18 |
| 3,529,985 | 9/1970 | Jester et al. | 241/29 |
| 3,948,448 | 4/1976 | Wehren et al. | 241/18 |
| 4,339,083 | 7/1982 | Linzberger et al. | 241/37 |
| 4,610,395 | 9/1986 | Ford | 241/5 |
| 4,641,787 | 2/1987 | Petersen et al. | 241/5 |
| 4,840,315 | 6/1989 | Rubin et al. | 241/24 |
| 5,154,362 | 10/1992 | Knobloch et al. | 241/24 |

OTHER PUBLICATIONS

*International Standard, ISO 7724*, Switzerland, 1984, Part 1:Principles, 8 pages.

*International Standard, ISO 7724*, Switzerland, 1984, Part 2:Colour measurement, 9 pages.

*International Stardard, ISO 7724*, Switzerland, 1984, Part 3:Calculation of colour differences, 6 pages.

*ASTM D 2244–89*, pp. 297–301, 1989.

*Primary Examiner*—John Husar

*Attorney, Agent, or Firm*—Connolly & Hutz

[57] ABSTRACT

The invention relates to a process for jet grinding inorganic pigments comprising the steps of compacting the inorganic pigments on a roller compactor at a predetermined linear force, and jet grinding the compacted inorganic pigments.

6 Claims, No Drawings

PROCESS FOR THE JET MILLING OF INORGANIC PIGMENTS

The present invention relates to a process for the jet milling of inorganic pigments.

The production of pigments requires milling operations for obtaining competitive products. Thus in the production of $TiO_2$ or iron oxide pigments, the dry products obtained are normally ground in hammer mills, pinned disc mills, collar mills, pendulum mills or steam jet mills (Ullmanns Encyklopädie der technischen Chemie, 4th revised and enlarged Edition, Volume 18, pages 576 and 601). Commercial jet mills (air, steam) are conventionally used for the finest grinding to obtain products with high optical performance and a low proportion of coarse particles.

The disadvantages of jet milling lie in the fact that if finer products and therefore better color values are to be obtained, it is necessary to use more steam or air in proportion to the pigment for the grinding process. This increases the cost and the exhaust air purifying systems must be designed for larger quantities of gas. Another disadvantage is that the pigment must be transported to the jet mill in the form of a powder, which gives rise to problems of dust pollution. Moreover, powders tend to stick so that they are difficult to measure accurately into the mills.

It is an object of the present invention to provide a process which is free from the above-described disadvantages.

The above-described disadvantages can surprisingly be solved by compacting the pigment on a drum compactor of specific or predetermined linear force before it is jet milled. This invention relates to such a process.

This preliminary step of the process results in a material which can easily be dosed and does not produce dust. Moreover, improved product properties are obtained under identical conditions in the jet mill, i.e. without increasing the quantities of steam or air.

The process according to the invention is basically suitable for grinding all known inorganic pigments. In one particularly preferred embodiment of the process according to the invention, the inorganic pigments are iron oxides, titanium oxides or chromium oxides.

The color shades were determined according to DIN 6174 (equivalent to ISO DIN 7724, 1–3 drafts). For brightening colored pigments, 1 part of pigment and 5 parts of $TiO_2$ of the Trade Product of Bayer AG, R-KB-2(R) are used. According to DIN 55982 and DIN 55986, the standard color value Y was used as comparison criterion.

The brightening capacity was determined according to DIN 55 982.

Determination of the particle distribution was carried out according to Ullmanns Encyclopedia of Industrial Chemistry, Fifth Completely Revised Edition, Volume B 2, Unit Operations I, Kurt Leschonski 2. Particle Size Analysis and Characterisation of a Classification Process (pages 2–30).

Some Examples, which are not to be regarded as limiting, are given below.

EXAMPLE 1

Grinding of $TiO_2$ pigment, Trade Product of Bayer AG Bayertitan(R) R-KB-2

| | Brightening | | | |
|---|---|---|---|---|
| | 0.5% AV | PVK* Rz-Rx | 15% AV | PVK Rz-Rx |
| 1. Normal jet grinding | 100 | 3.0 | 100 | 5.6 |
| 2. Compacting at 10 kN/cm followed by jet grinding | 102 | 3.1 | 109 | 6.1 |
| 3. Compacting at 25 kN/cm followed by jet grinding | 107 | 3.4 | 111 | 6.4 |

PVK=Pigment volume concentration

The increased values in AV and Rz-Rx indicate that the particle size distribution is improved and the user requires less pigment for obtaining the same color result.

EXAMPLE 2

Grinding of material for Bayferrox(R) 3910, Trade Product of Bayer AG.

Compacting was first carried out at 5 and, respectively, 10 kN/cm and this was followed by steam grinding of the compacted product. The data for the Trade Product Bayferrox(R) 3910 are shown for comparison.

a) Color values, all data given as delta values relative to the Trade Product Bayferrox(R) 3910. The relative color intensity is 100% in the Trade Product.

| | a* | b* | c* | h | Color intensity [%] |
|---|---|---|---|---|---|
| 3910 | 0.0 | 0.0 | 0.0 | 0.0 | 100 |
| Compacted | | | | | |
| at 5 kN/cm | 0.0 | +0.6 | +0.6 | +0.1 | 101 |
| 10 kN/cm | 0.0 | +0.5 | +0.5 | +0.1 | 102 |

b) Particle size distribution, data showing at which particle size in μm 10%, 50% or 90% of the total quantity is smaller than the given sizes.

| | 10% A | 50% B | 90% C | Range of distribution C-A/B |
|---|---|---|---|---|
| 3910 | 0.21 | 0.47 | 1.09 | 1.85 |
| Compacted | | | | |
| at 5 kN/cm | 0.20 | 0.39 | 0.82 | 1.57 |
| 10 kN/cm | 0.32 | 0.47 | 0.68 | 0.79 |

The increase in color values b* and C* shows the improvement in color values. This correlates with the improved particle size distribution. In this case the 90% value (C) indicates that the proportion of coarse particles decreases and the range of particles sizes decreases.

What is claimed is:

1. A process for jet grinding inorganic pigments comprising the steps of compacting the inorganic pigments on a roller compactor at a predetermined linear force, jet grinding the compacted inorganic pigments, and disagglomerating the inorganic pigments between the compacting and jet grinding steps.

2. A process as in claim 1 wherein the predetermined linear force is in the range of 1 to 60 KN/cm.

3. A process as in claim 1 wherein the step of disagglomerating the inorganic pigments is accomplished with fine impact mills, ball mills of crushing mills.

4. A process as in claim 1 wherein the inorganic pigments being processed are selected from the group consisting of iron oxides, titanium dioxide, chromium oxide and mixed phase pigments.

5. A process as in claim 1 including the step of applying an organic or inorganic grinding auxiliary to the inorganic pigments by spraying before the compacting step.

6. A process as in claim 1 including the step of applying an organic or inorganic grinding auxiliary to the inorganic pigments by spraying after the compacting step.

* * * * *